United States Patent [19]

Bartylla

[11] Patent Number: 4,746,062

[45] Date of Patent: May 24, 1988

[54] NEWSPAPER CONTAINER

[76] Inventor: Thomas Bartylla, 5368 Portland Ave., White Bear Lake, Minn. 55110

[21] Appl. No.: 98,287

[22] Filed: Sep. 18, 1987

[51] Int. Cl.[4] ..... A47G 29/12

[52] U.S. Cl. ..... 232/1 C; 232/22

[58] Field of Search ..... 232/1 C, 1 E, 22, 19, 232/21, 43.1, 43.3

[56] References Cited

U.S. PATENT DOCUMENTS

| | | | |
|---|---|---|---|
| 320,956 | 6/1885 | Osgood et al. . | |
| 331,760 | 12/1885 | Blair | 232/22 |
| 948,556 | 2/1910 | Turner | 232/22 |
| 999,724 | 8/1911 | Althouse | 232/22 |
| 1,128,678 | 2/1915 | Giclas . | |
| 4,066,208 | 1/1978 | Jones | 232/22 X |
| 4,098,454 | 7/1978 | Easter . | |
| 4,494,690 | 1/1985 | Dupis | 232/1 C |

*Primary Examiner*—Robert W. Gibson, Jr.

*Attorney, Agent, or Firm*—James R. Haller

[57] ABSTRACT

A container for receiving and retaining newspapers and the like which is attached to the outside surface of a door. To receive singly folded newspapers downwardly inserted into it, the container has a slot opening in its upper horizontal surface. The container also comprises a drawer which is used to retain the newspaper in the device and to transport the newspaper to a side opening in the container for its removal. When the apartment door is closed, the drawer handle abuts the adjacent door jamb prohibiting the opening of the drawer. In order to open the drawer and withdraw the newspaper, the apartment door must be opened a sufficient distance to allow the drawer to be slid open clear of the door jamb. A hand restraining means is included in the container assembly to discourage a hand from being inserted into its top opening to remove its contents. The container is mounted to both vertical edges of a door adjacent to the door exterior surface.

9 Claims, 3 Drawing Sheets

NEWSPAPER CONTAINER

FIELD OF THE INVENTION

The invention relates to an improved container to receive and retain newspapers and other articles that are hand-delivered to a home, apartment, or condominium.

BACKGROUND OF THE INVENTION

When newspapers or other articles are hand-delivered to a home, apartment, condominium, or the like, they often are left on the doorstep of the unit which can cause many problems. The newspapers or other articles can be easily blown away by a wind, soaked by a rain shower, or stolen. Also, accumulation of newspapers can alert a burglar that nobody is home.

Several attempts have been made to alleviate these problems. U.S. Pat. No. 4,494,690 discloses a small compartment clipped to one edge of a door in which the newspaper, of necessity, must be folded to be inserted into the device, the interior of the compartment becoming accessible when the door to which it is clipped is opened. A similar device with a trap door to receive a newspaper is shown in U.S. Pat. No. 320,956. A tubular container that is clipped to the bottom of a door is disclosed in U.S. Pat. No. 4,066,208.

DISCLOSURE OF THE INVENTION

The present invention relates to a door-mounted container for receiving and retaining newspapers or similar items, preventing others from taking these items. It has been observed that doors of apartment units, condominiums, and homes usually open inwardly, and the door jamb extends outwardly beyond the outer surface of the door. The container comprises a generally upright housing having end mountable desirably to vertical opposed edge surfaces of a door. The housing has a generally vertical opening adjacent one edge and an upwardly open opening along its top surface. The container also includes a drawer carried slidably within the housing and having an open top to receive a newspaper or similar item deposited downwardly through the upwardly open opening of the housing. To enable a newspaper within the drawer to be removed when the door is open, the drawer is slidable outwardly of the housing through the vertical side opening in the housing, the drawer having a manually graspable handle adjacent the vertical opening in the housing. The drawer is so positioned as to closely confront a door jamb when mounted to a door such that when the door is closed, the drawer is prevented from being withdrawn from the housing.

DETAILED DESCRIPTION OF THE PREFERRED EMBODIMENT

Figure 3:
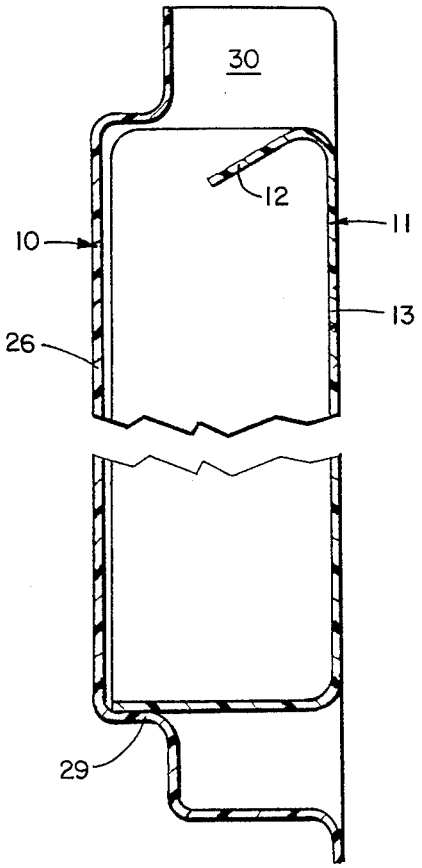
FIG. 3 is a broken-away cross-sectional view taken along line 3—3 of FIG. 1.

The newspaper container of the invention comprises a generally upright housing providing a generally rectangular external casing (10) defining, with the adjacent door surface (23), an upright container, attachment means carried by the housing for securing it to a door, and a sliding drawer (11). Preferably the external casing (10) and the drawer (11) are made of a suitable durable, weather-resistant material such as plastic or fiberglass. The external casing (10) provides a bottom internal surface or floor (29) (See FIG. 3) upon which the drawer (11) is slidably supported and also provides internal end and side surfaces (30) and (26) respectively. A triangular portion (15) of the external casing (10) extending outwardly of the end (30) generally parallel to the side surface (31) adds structural support to the external casing (10). The external casing (10) has two elongated rectangular openings (19) and (16), one located on its top horizontal surface, and one on the side opposite the triangular portion (15).

Figure 1:
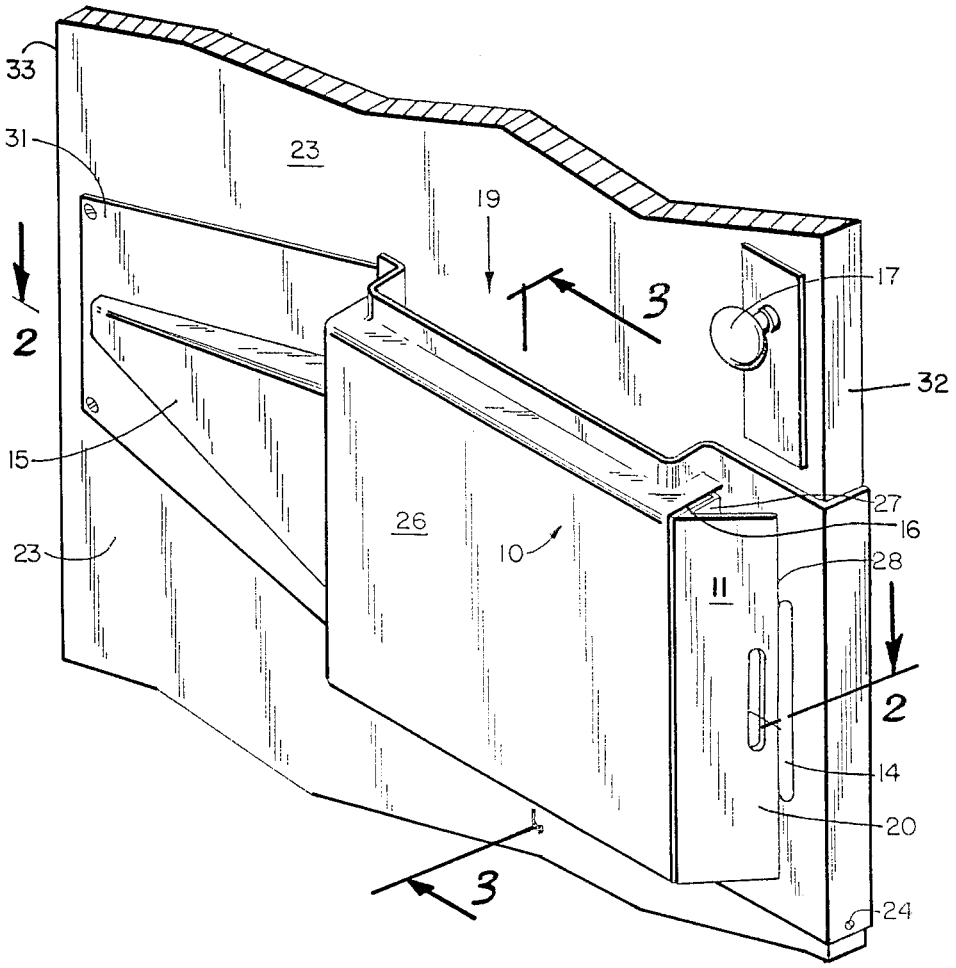
FIG. 1 is a perspective view of a newspaper container of the invention, shown attached to a door.
Figure 2:
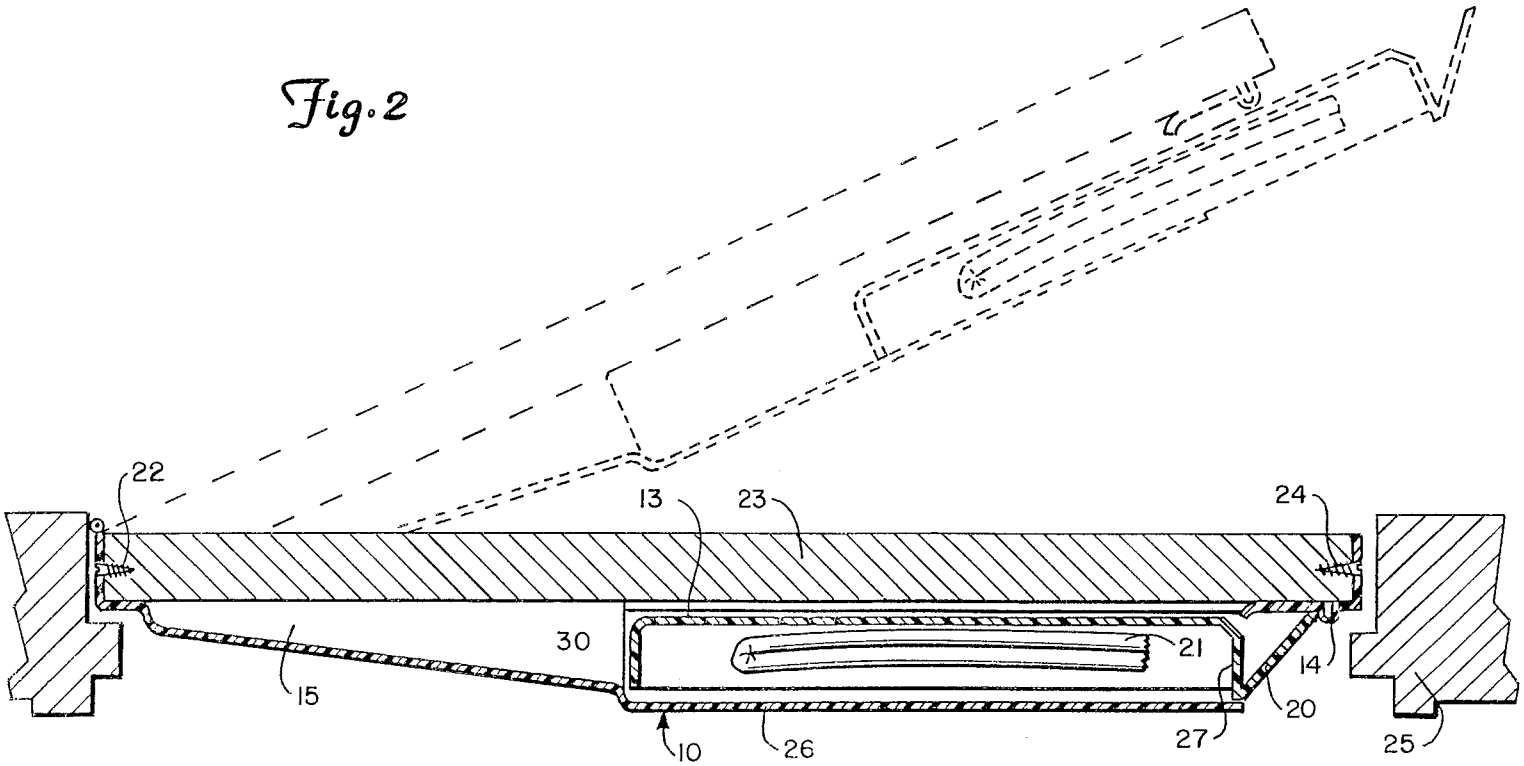
FIG. 2 is a cross-sectional view taken along line 2—2 of FIG. 1 and showing an associated door and door jamb, the door being shown in an open position by phantom lines.

A drawer (11), shaped like a shallow box with a long vertical dimension and an open top (19), is used to receive a newspaper (21) through its upwardly open top and to transport the paper through the side opening (16) in the external casing (10) when the drawer (11) is opened. The drawer (11) includes a side wall (13) parallel to but spaced from the side wall (26) of the casing. One side of the drawer (11) adjacent to the open side of the casing has a vertical wall (27) blocking the vertical opening (16) in the casing when the drawer (11) is in its closed position as shown in FIG. 1.

A handle (20) preferably includes a vertical wall (20) extending at an acute angle from the wall (27) and terminating at an edge (28). The drawer (11) also may include a hand restraining tab (12) carried by its upper edge and extending partially into the rectangular opening (19) to prohibit a hand from reaching through the top opening in the container. A vertical projection (14) carried by the casing (10) forms a stop positioned to encounter the edge (28) of the drawer handle (20) to thus restrain removal of the drawer 11 from the casing (10 . The drawer (11) has sufficient resilience as to enable the edge (28) to be resiliently disengaged from the stop (14) when the drawer (11) is to be opened. If desired, a spring may be used to urge the drawer (11) into the container housing, eliminating the need for the drawer stop (14). To open the drawer (11), a force is exerted outwardly on the drawer (11) to oppose the inwardly directed force of the spring. When the drawer (11) is released in the open position, it will be retracted into the container and held in a closed position by the spring.

Means are provided to attach the newspaper container to a door (23) with the drawer (11) between the container casing (10) and the outside surface of the door (23). In a preferred means, the external casing (10) extends across the outer surface of the door (23) and wraps around the adjacent opposed vertical edge surfaces (32) and (33) of the door. The casing (10) is attached to the edges (32) and (33) of the door by nails, screws (22) and (24), or other suitable attachment means. The portions of the external casing (10) that extend across the door edges (32) and (33) are thin enough to provide adequate clearance between the container and the door jamb (25) so as not to interfere with the operation of the door (23). The newspaper container can be mounted above or below the doorknob (17) depending upon the application and may be formed in several sizes to accomodate doors of different widths.

Alternatively, the attachment means may comprise a plurality of right angled brackets which may be overlappingly and adjustably attached to the side edges of the external casing (10) on the front surface of the door (23), and which extend thence to the edges (32) and (33) of the door (23), bend 90 degrees along the edges (32) and (33) of the door (23), and are fastened to the opposed vertical edges (32) and (33) of the door (23) by means of screws (22) and (24), nails, or other suitable fastening means.

To operate the assembly, the door (23) is opened to expose the side opening of the container (16) and, using the handle (20), the drawer (11) is withdrawn horizontally outwardly of the casing (10) to allow removal of the contents of the drawer (11). To close the assembly, the drawer (11) is slid horizontally into the side opening (16) of the container and the handle (20) is lifted over the protruding drawer stop (14). Once the handle (20) contacts the inside surface of the drawer stop (14), the door (23) can be closed and the newspaper container is ready for reception of the next delivery.

While a preferred embodiment of the present invention has been described, it should be understood that various changes, adaptations and modifications may be made therein without departing from the spirit of the invention and the scope of the appended claims.

What is claimed is:

1. A container mountable to a door for receiving and retaining newspapers and the like, comprising:

(a) a generally upright housing having means for mounting the housing to a door, the housing having a generally vertical opening adjacent one edge and having an upwardly open opening; and (b) a drawer carried within the housing and having an open top to receive a newspaper or the like deposited within the upwardly open opening of the housing, the drawer being slidable outwardly of the housing through said vertical opening to enable a newspaper within the drawer to be removed, said drawer having a manually graspable handle adjacent the vertical opening in the housing and having a portion extending substantially to said end of the housing, the drawer portion and housing end being so positioned as to closely confront a door jamb when mounted to a door such that when the said door is closed, said drawer is prevented from being withdrawn from the housing.

2. The container of claim 1 wherein said mounting means comprises end portions of the housing shaped to bend 90° around vertical, opposed edge surfaces of a door, and to be there attached.

3. The container of claim 1 wherein the said sliding drawer is parallelepiped in shape and includes walls defining an open, forwardly facing side for removal of newspapers or the like when the drawer is opened.

4. The container of claim 3 wherein a side of the drawer extends outwardly through said vertical side opening in the housing, said handle being carried by the last mentioned drawer side.

5. The container of claim 4 wherein said handle is attached to the drawer along the length of an edge and extends outwardly and backwardly from the exterior surface of the drawer at an acute angle to the side of the drawer to which it is attached.

6. The container of claim 5 wherein said handle includes a centrally located slot opening through which fingers of a hand may be inserted to grasp the handle.

7. The container of claim 6 wherein said drawer includes a hand restraining tab attached to the top edge of the back side of the drawer extending generally inwardly and downwardly into the drawer at an acute angle to the back side of the drawer a sufficient distance to prohibit a hand from entering the upwardly open opening in the housing when the housing and the drawer are closely arranged and configured composing the assembly.

8. The container of claim 1 including a protrusion extending from the front surface of the housing and defining a drawer stop to prevent the drawer from sliding through the vertical side opening in the housing unexpectedly when the door is opened.

9. A container mountable to a door for receiving and retaining newspapers and the like, comprising:

(a) a generally upright housing having means for mounting the housing to a door, said mounting means comprising end portions of the housing shaped to bend 90 degrees around vertical, opposed edge surfaces of a door, and to be there attached, the housing having a generally vertical opening adjacent one edge and having an upwardly open opening, said housing further including a protrusion extending from the front surface of the housing and defining a drawer stop to prevent a drawer from sliding inadvertently through the vertical side opening in the housing; and (b) a drawer carried within the housing and having an open top to receive a newspaper or the like deposited within the upwardly open opening of the housing, said sliding drawer being parallelepiped in shape and including walls defining an open, forwardly facing side for removal of newspapers or the like when the drawer is slid outwardly of the housing through said vertical opening, said drawer having a manually graspable handle adjacent said vertical opening in the housing and having a portion extending substantially to said end of the housing, the handle being attached to the drawer along the length of an edge and extending outwardly and backwardly from the exterior surface of the drawer at an acute angle to the side of the drawer to which it is attached, the handle including a centrally located slot opening through which fingers may be inserted to grasp the handle, said drawer further including a hand restraining tab attached to a top edge of the back side of the drawer extending generally inwardly and downwardly into the drawer at an acute angle to the back side of the drawer a sufficient distance to prohibit a hand from entering the upwardly open opening in the housing.

* * * * *